US011705004B2

(12) United States Patent
Bielby

(10) Patent No.: US 11,705,004 B2
(45) Date of Patent: Jul. 18, 2023

(54) SYSTEMS AND METHODS FOR AUTOMATICALLY WARNING NEARBY VEHICLES OF POTENTIAL HAZARDS

(71) Applicant: Micron Technology, Inc., Boise, ID (US)

(72) Inventor: Robert Richard Noel Bielby, Placerville, CA (US)

(73) Assignee: Micron Technology, Inc., Boise, ID (US)

( * ) Notice: Subject to any disclaimer, the term of this patent is extended or adjusted under 35 U.S.C. 154(b) by 90 days.

(21) Appl. No.: 17/175,532

(22) Filed: Feb. 12, 2021

(65) Prior Publication Data

US 2021/0241622 A1 Aug. 5, 2021

Related U.S. Application Data

(63) Continuation of application No. 16/526,752, filed on Jul. 30, 2019, now Pat. No. 10,971,013, which is a (Continued)

(51) Int. Cl.

*G08G 1/00* (2006.01)
*G08G 1/16* (2006.01)

(Continued)

(52) U.S. Cl.

CPC ..... *G08G 1/162* (2013.01); *G08G 1/0112* (2013.01); *G08G 1/0116* (2013.01); *G08G 1/0133* (2013.01); *G08G 1/052* (2013.01)

(58) Field of Classification Search

USPC ..... 701/117

See application file for complete search history.

(56) References Cited

U.S. PATENT DOCUMENTS 6,292,719 B1 * 9/2001 Seto ..... B60K 31/0058 701/1
7,516,041 B2 * 4/2009 Smartt ..... G01C 21/3819 702/167

(Continued)

FOREIGN PATENT DOCUMENTS

CN 107368076 11/2017
WO 2019092439 5/2019

OTHER PUBLICATIONS

Atoum, et al. "Monocular Video-Based Trailer Coupler Detection Using Multiplexer Convolutional Neural Network." IEEE International Conference on Computer Vision, Oct. 2017.

(Continued)

*Primary Examiner* — Jonathan M Dager
(74) *Attorney, Agent, or Firm* — Greenberg Traurig

(57) ABSTRACT

Systems for automatically warning at least one nearby vehicle of a potential safety hazard in or near a roadway, including one or more sensors configured to detect a potential safety hazard in or near a roadway; a memory containing computer-readable instructions for generating a message including at least one of a location of the one or more sensors and a location of the potential safety hazard; a processor configured to read the computer-readable instructions from the memory and generate the message; and a transmitter configured to wirelessly transmit the message to at least one nearby vehicle. Systems for coordinating actions of a first vehicle and a second vehicle upon detection of a potential safety hazard in or near a roadway, including in part evaluating whether the actions conflict and, if so, requesting that the first vehicle execute alternative actions for avoiding or mitigating risk of collision. Corresponding methods are disclosed.

19 Claims, 6 Drawing Sheets

Related U.S. Application Data continuation of application No. 15/957,631, filed on Apr. 19, 2018, now Pat. No. 10,522,038.

(51) Int. Cl.
*G08G 1/01* (2006.01)
*G08G 1/052* (2006.01)

(56) References Cited

U.S. PATENT DOCUMENTS 8,520,695 B1 * 8/2013 Rubin ..... H04W 72/30 370/445
9,245,188 B2 1/2016 Han
9,413,779 B2 8/2016 Vasseur et al.
9,450,978 B2 9/2016 Vasseur et al.
9,503,466 B2 11/2016 Vasseur et al.
9,521,158 B2 12/2016 Di Pietro et al.
9,563,854 B2 2/2017 Cruz Mota et al.
9,656,606 B1 * 5/2017 Vose ..... G01S 19/42
9,672,734 B1 6/2017 Ratnasingam
9,733,093 B2 * 8/2017 Denaro ..... G06F 16/444
9,751,534 B2 9/2017 Fung et al.
9,752,884 B2 * 9/2017 Denaro ..... G09B 29/007
9,797,735 B2 * 10/2017 Denaro ..... G06F 16/219
9,805,601 B1 * 10/2017 Fields ..... G08G 1/0129
9,947,145 B2 * 4/2018 Wang ..... G07C 5/008
10,001,760 B1 6/2018 Hoffmann et al.
10,007,269 B1 6/2018 Gray
10,019,654 B1 7/2018 Pisoni
10,157,422 B2 * 12/2018 Jordan Peters .... G06Q 30/0207
10,185,999 B1 * 1/2019 Konrardy ..... G06Q 40/08
10,217,028 B1 2/2019 Wang et al.
10,254,760 B1 4/2019 Abeloe
10,296,004 B2 * 5/2019 Nishi ..... G05D 1/0276
10,311,312 B2 6/2019 Yu et al.
10,366,502 B1 7/2019 Li
10,459,444 B1 10/2019 Kentley-klay
10,522,038 B2 12/2019 Bielby
10,549,781 B2 * 2/2020 Park ..... B60W 10/20
10,599,546 B1 3/2020 Walther et al.
10,611,379 B2 4/2020 Olabiyi et al.
10,672,200 B2 6/2020 Wang et al.
10,678,244 B2 6/2020 Iandola et al.
10,713,955 B2 7/2020 Tong et al.
10,733,506 B1 8/2020 Ogale et al.
10,971,013 B2 4/2021 Bielby
10,994,741 B2 5/2021 Zhou et al.
11,120,353 B2 9/2021 Olabiyi et al.
11,188,821 B1 11/2021 Kalakrishnan et al.
11,328,210 B2 5/2022 Mondello et al.
11,417,109 B1 * 8/2022 Theimer ..... G06N 3/08
11,427,190 B2 * 8/2022 Yang ..... G08G 1/096741
11,577,719 B2 * 2/2023 Tanahashi ..... B60W 30/0956
2002/0194016 A1 * 12/2002 Moribe ..... G01C 21/3605 701/469
2004/0128062 A1 * 7/2004 Ogino ..... G01C 21/3697 455/414.1
2004/0215373 A1 * 10/2004 Won ..... G08G 1/161 701/1
2005/0278118 A1 * 12/2005 Kim ..... G08G 1/096775 701/469
2007/0296574 A1 * 12/2007 Smith ..... G08G 1/0962 340/539.13
2008/0243380 A1 * 10/2008 Han ..... G01C 21/3697 701/431
2009/0299630 A1 * 12/2009 Denaro ..... G06F 16/29 707/999.001
2009/0300035 A1 * 12/2009 Denaro ..... G01C 21/3697
2009/0300053 A1 * 12/2009 Denaro ..... B60W 50/0097 707/999.102
2010/0019891 A1 * 1/2010 Mudalige ..... G08G 1/167 340/425.5
2010/0241353 A1 * 9/2010 Park ..... G01C 21/30 701/532
2010/0332266 A1 * 12/2010 Tamir ..... H01L 23/49838 340/901
2011/0190972 A1 * 8/2011 Timmons ..... G08G 1/167 701/31.4
2011/0304447 A1 * 12/2011 Marumoto ..... G07C 5/085 340/438
2012/0166229 A1 * 6/2012 Collins ..... G06Q 40/08 705/4
2012/0203418 A1 * 8/2012 Braennstroem ..... B60W 30/09 701/1
2012/0323474 A1 * 12/2012 Breed ..... G08G 1/161 701/117
2013/0317665 A1 * 11/2013 Fernandes ..... G08G 5/0039 701/1
2013/0325306 A1 * 12/2013 Caveney ..... B60W 30/0953 701/117
2013/0346350 A1 12/2013 Subramanian et al.
2014/0081505 A1 * 3/2014 Klinger ..... G08G 5/0004 701/25
2014/0201126 A1 7/2014 Zadeh et al.
2015/0026108 A1 1/2015 Portegys et al.
2015/0100530 A1 4/2015 Mnih et al.
2015/0161454 A1 6/2015 Han
2015/0179066 A1 * 6/2015 Rider ..... G08G 1/04 701/31.5
2015/0185026 A1 * 7/2015 Hightower ..... G01C 21/3658 701/533
2015/0193693 A1 7/2015 Vasseur et al.
2015/0193694 A1 7/2015 Vasseur et al.
2015/0193695 A1 7/2015 Cruz Mota et al.
2015/0193696 A1 7/2015 Vasseur et al.
2015/0193697 A1 7/2015 Vasseur et al.
2015/0195145 A1 7/2015 Di Pietro et al.
2015/0195146 A1 7/2015 Di Pietro et al.
2015/0254555 A1 9/2015 Williams, Jr. et al.
2015/0324686 A1 11/2015 Julian et al.
2015/0324923 A1 * 11/2015 Christensen ..... G06Q 10/0635 705/4
2016/0020943 A1 1/2016 Diab et al.
2016/0027305 A1 * 1/2016 Inaba ..... G08G 1/0112 340/905
2016/0042642 A1 * 2/2016 Yamashiro ..... G08G 1/137 340/990
2016/0061625 A1 * 3/2016 Wang ..... G08G 1/012 701/454
2016/0078339 A1 3/2016 Li et al.
2016/0104047 A1 4/2016 Sibiryakov
2016/0223343 A1 * 8/2016 Averbuch ..... B60W 50/14
2016/0363935 A1 * 12/2016 Shuster ..... G08G 1/0141
2017/0008168 A1 1/2017 Weng et al.
2017/0008521 A1 1/2017 Braunstein et al.
2017/0024938 A1 * 1/2017 Lindsay ..... H04B 10/1129
2017/0053530 A1 * 2/2017 Gogic ..... H04W 4/46
2017/0084177 A1 * 3/2017 Matsuoka ..... G08G 1/163
2017/0101054 A1 * 4/2017 Dusane ..... G08G 1/096741
2017/0101093 A1 * 4/2017 Barfield, Jr. ..... G08G 1/09675
2017/0132527 A1 5/2017 Ahn et al.
2017/0144657 A1 * 5/2017 Hassani ..... B60W 10/20
2017/0162051 A1 * 6/2017 Satoh ..... G05D 1/0011
2017/0169208 A1 6/2017 Jantz et al.
2017/0200284 A1 7/2017 Lee et al.
2017/0221362 A1 * 8/2017 Gunaratne ..... G08G 1/166
2017/0242436 A1 * 8/2017 Creusot ..... G08G 1/09626
2017/0262735 A1 9/2017 Ros Sanchez et al.
2017/0293808 A1 10/2017 Jain et al.
2017/0305434 A1 * 10/2017 Ratnasingam ..... B60W 50/14
2018/0018775 A1 1/2018 Piekniewski et al.
2018/0025268 A1 1/2018 Teig et al.
2018/0053071 A1 2/2018 Chen et al.
2018/0068206 A1 * 3/2018 Pollach ..... G06V 20/56
2018/0082137 A1 * 3/2018 Melvin ..... G06F 18/213
2018/0157920 A1 * 6/2018 Hu ..... G01S 17/89
2018/0164825 A1 * 6/2018 Matus ..... B60W 30/00
2018/0173971 A1 6/2018 Jia et al.
2018/0174023 A1 6/2018 Imam et al.
2018/0174457 A1 6/2018 Taylor
2018/0188733 A1 7/2018 Iandola et al.
2018/0211524 A1 * 7/2018 Furuichi ..... G08G 1/162

(56) References Cited

U.S. PATENT DOCUMENTS

| | | | | |
|---|---|---|---|---|
| 2018/0215344 | A1* | 8/2018 | Santora | B60R 25/33 |
| 2018/0268266 | A1 | 9/2018 | Sohn et al. | |
| 2018/0285735 | A1 | 10/2018 | Baum et al. | |
| 2018/0292825 | A1 | 10/2018 | Smolyanskiy et al. | |
| 2018/0300964 | A1* | 10/2018 | Lakshamanan | G06F 9/5027 |
| 2019/0019082 | A1 | 1/2019 | Dasgupta et al. | |
| 2019/0034762 | A1 | 1/2019 | Hashimoto | |
| 2019/0035113 | A1 | 1/2019 | Salvi et al. | |
| 2019/0035277 | A1* | 1/2019 | Son | G08G 1/163 |
| 2019/0047555 | A1* | 2/2019 | Düring | B60W 30/09 |
| 2019/0050624 | A1 | 2/2019 | Chai et al. | |
| 2019/0072965 | A1* | 3/2019 | Zhang | G08G 1/161 |
| 2019/0082185 | A1 | 3/2019 | Satavalekar et al. | |
| 2019/0088132 | A1* | 3/2019 | Riggins | G05D 1/0278 |
| 2019/0098471 | A1* | 3/2019 | Rech | G08G 1/22 |
| 2019/0108651 | A1 | 4/2019 | Gu et al. | |
| 2019/0113927 | A1 | 4/2019 | Englard et al. | |
| 2019/0122109 | A1 | 4/2019 | Busch et al. | |
| 2019/0122543 | A1* | 4/2019 | Matus | G08G 1/096741 |
| 2019/0138889 | A1 | 5/2019 | Jiang et al. | |
| 2019/0147254 | A1 | 5/2019 | Bai et al. | |
| 2019/0147331 | A1 | 5/2019 | Arditi | |
| 2019/0164430 | A1* | 5/2019 | Nix | B60R 1/00 |
| 2019/0187706 | A1 | 6/2019 | Zhou et al. | |
| 2019/0187707 | A1 | 6/2019 | Zheng et al. | |
| 2019/0189007 | A1* | 6/2019 | Herman | G08G 1/0133 |
| 2019/0204088 | A1 | 7/2019 | Haque et al. | |
| 2019/0205744 | A1 | 7/2019 | Mondello et al. | |
| 2019/0205765 | A1 | 7/2019 | Mondello et al. | |
| 2019/0206255 | A1* | 7/2019 | Tao | G08G 1/00 |
| 2019/0221125 | A1* | 7/2019 | Kato | G08G 1/166 |
| 2019/0251396 | A1 | 8/2019 | Geraci et al. | |
| 2019/0256064 | A1* | 8/2019 | Hecker | B60W 50/0205 |
| 2019/0258251 | A1 | 8/2019 | Ditty et al. | |
| 2019/0268726 | A1* | 8/2019 | Jiang | G01S 5/0284 |
| 2019/0272433 | A1 | 9/2019 | Yu et al. | |
| 2019/0279028 | A1 | 9/2019 | Wang et al. | |
| 2019/0325750 | A1 | 10/2019 | Bielby | |
| 2019/0355256 | A1 | 11/2019 | Bielby | |
| 2020/0019794 | A1 | 1/2020 | Engelcke et al. | |
| 2020/0026283 | A1 | 1/2020 | Barnes et al. | |
| 2020/0068250 | A1 | 2/2020 | Bhooi et al. | |
| 2020/0101917 | A1* | 4/2020 | Kumar | G08G 1/0129 |
| 2020/0118436 | A1* | 4/2020 | Gogic | H04W 4/46 |
| 2020/0130685 | A1* | 4/2020 | Nguyen | B60W 60/001 |
| 2020/0209810 | A1 | 7/2020 | Bazhenov et al. | |
| 2020/0249683 | A1* | 8/2020 | Rosales | G08G 1/164 |
| 2020/0257301 | A1 | 8/2020 | Weiser et al. | |
| 2020/0279129 | A1 | 9/2020 | Batchelor et al. | |
| 2020/0401136 | A1 | 12/2020 | Iandola et al. | |
| 2020/0411737 | A1 | 12/2020 | Barnes et al. | |
| 2020/0604464 | | 6/2021 | Jobling et al. | |
| 2022/0237469 | A1 | 7/2022 | Mondello et al. | |
| 2022/0264270 | A1* | 8/2022 | Monteuuis | H04W 4/50 |

OTHER PUBLICATIONS

Chen, et al. "Brain-Inspired Cognitive Model with Attention for Self-Driving Cars." Feb. 19, 2017.

Eraqi, et al. "End-toEnd Deep Learning for Steering Autonomous Vehicles Considering Temporal Dependencies." 31st Conference on Neural Information Processing Systems, Nov. 22, 2017.

Hou, et al. "Fast Recurrent Fully Convolutional networks for Direct Perception in Autonomous Driving." Nov. 20, 2017.

Liu, et al. "A Unified Cloud Platform for Autonomous Driving." IEEE Computer Society, Dec. 18, 2017.

Pan, et al. "Agile Off-Road Autonomous Driving Using End-to-End Deep Imitation Learning." Sep. 21, 2017.

Sallab, et al. "Meta Learning Framework for Automated Driving." Jun. 11, 2017.

Shapiro, Danny. "Accelerating the Race to Autonomous Cars." Aug. 2016.

Wang, et al. "Reconfigurable Processor for Deep Learning in Autonomous Vehicles." International Telecommunication Union, Sep. 2017.

Aljosa Osep, et al. "Large-Scale Object Discovery and Detector Adaptation from Unlabeled Video." arXiv:1712.08832v1, Dec. 23, 2017.

Chelsea Finn, et al. "Generalizing Skills with Semi-Supervised Reinforcement Learning." Conference paper at ICLR, 2017.

David Stavens, et al. "A Self-Supervised Terrain Roughness Estimator for Off-Road Autonomous Driving." arXiv:1206.6872, Jun. 27, 2012.

Evan Shelhamer, et al. "Loss is its own Reward: Self-Supervision for Reinforcement Learning." arXiv:1612.07307, Mar. 9, 2017.

Guy Rosman, et al. "Hybrid Control and Learning with Coresets for Autonomous Vehicles." IEEE/RSJ International Conference on Intelligent Robots and Systems (IROS), IEEE, Sep. 24-28, 2017.

Junhong Xu, et al. "Avoidance of Manual Labeling in Robotic Autonomous Navigation Through Multi-Sensory Semi-Supervised Learning." arXiv:1709.07911v3, Oct. 9, 2017.

Miguel A. Bautista, et al. "Learning Where to Drive by Watching Others." German Conference on Pattern Recognition, Aug. 15, 2017.

Mohammed Abdulla Yousuf, et al. U.S. "Systems and Methods for Safe and Reliable Autonomous Vehicles." U.S. Appl. No. 62/584,549, filed Nov. 10, 2017.

Xiaohang Zhan. "Mix-and-Match Tuning for Slef-Supervised Semantic Segmentation." Association for the Advancement of Artificial Intelligence (AAAI), 2018.

Yiran Zhong, et al. "Self-Supervised Learning for Stereo matching with Self-Improving Ability." arXiv:1709.00930v1, Sep. 4, 2017.

Systems and Methods for Automatically Warning nearby Vehicles of Potential Hazards, U.S. Appl. No. 15/957,631, filed Apr. 19, 2018, Robert Bielby, Patented Case, Jul. 11, 2019.

Systems and Methods for Automatically Warning Neaby Vehicles of Potential Hazards, U.S. Appl. No. 16/526,752, filed Jul. 30, 2019, Robert Bielby, Patented Case, Apr. 28, 2020.

Distributed Architecture for Enhancing Artificial Neural Network, U.S. Appl. No. 15/858,143, filed Dec. 29, 2017, Antonino Mondello et al., Final Rejection Mailed, dated Feb. 11, 2022.

Self-Learning in Distributed Architecture for Enhancing Artificial Neural Network, U.S. Appl. No. 15/858,505, filed Dec. 29, 2017, Antonino Mondello et al., Publications—Issue Fee Payment Verified, Aug. 9, 2021.

Self-Learning in Distributed Architecture for Enhancing Artificial Neural Network, U.S. Appl. No. 17/718,701, filed Apr. 12, 2022, Antonino Mondello et al., Application Undergoing Preexam Processing, Apr. 12, 2022.

Jin et al., "Howto scale distributed deep learning?" arXiv1611.04581v1, Nov. 14, 2016.

Olabiyi et al., "Driver Action Prediction Using Deep (Bidirectional) Recurrent Neural Network." arXiv:1706.02257, Jun. 7, 2017.

Skende, Andi, "Introducing 'Parker' Next-Generation Tegra System-On-Chip." Aug. 2016.

Wu et al., "SqueezeDet: Unified, Small, Low Power Fully Convolutional Neural Networks for Real-Time Object Detection for Autonomous Driving." arXiv:1612.01051v3, Nov. 29, 2017.

Bojarski et al., "End to End Learning for Self-Driving Cars." arXiv:1604.07316v1, Apr. 25, 2016.

Fridman et al., "MIT Autonomous Vehicle Technology Study: Large-Scale Deep Learning Based Analysis of Driver Behavior and Interaction with Automation." arXiv:1711.06976v1, Nov. 19, 2017.

International Search Report and Written Opinion, PCT/US2018/063669, dated Mar. 25, 2019.

Pan et al., "Virtual to Real Reinforcement Learning for Autonomous Driving." arXiv:1704.03952v3, May 11, 2017.

Santana et al., "Learning a Driving Simulator." arXiv:1608.01230v1, Aug. 3, 2016.

Stem et al., "Dissipation of stop-and-go waves via control of autonomous vehicles: Field experiemnts." ARxIV:1705.01693V1, May 4, 2017.

Teichmann et al., "MultiNet: Real-time Joint Semantic Reasoning for Autonomous Driving." arXiv:1612.07695v1, Dec. 22, 2016.

(56) References Cited

OTHER PUBLICATIONS

Ashok, Ashwin, et al., "Enabling Vehicular Applications using Cloud Services through Adaptive Computation Offloading." ACM, Sep. 11, 2015.
Barnes, et al. "Driven to Distraction: Self-Supervised Distractor Learning for Robust Monocular Visual Odometry in Urban Environments." arXiv: 1711.06623v1, Nov. 17, 2017.
Barnes, et al. "Find Your Own Way: Weakly-Supervised Segmentation of Path Proposals for Urban Autonomy." arXiv:1610.012383, Nov. 17, 2017.
Kahn, et al. "Self-supervised Deep Reinforcement Learning with Generalized Computation Graphs for Robot Navigation." arXiv:1709.10489v2, Nov. 30, 2017.
Liebig, Thomas, et al., "Distributed Traffic Flow Prediction with Label Proprotions: From in-Network towards High Performance Computation with MPI." Proceedings of the 2nd International Workshop on Mining Urban Data, 2015.
Pan, et al. "Spatial As Deep: Spatial CNN for Traffic Scene Understanding." arXiv:1712.06080v1, Dec. 17, 2017.
Richter, et al. "Safe Visual navigation via Deep learning and Novelty Detection." Robotics: Science and Systems XIII, Jul. 12, 2017.
Wang, et al. "Understanding Convolution for Semantic Segmentation." arXIV:1702.08502v2, Nov. 9, 2017.
Wikipedia. "Self-supervised learning." Retrieved from the Internet <https://en.wikipedia.org/wiki/Self-supervised_learning> on May 31, 2022.

* cited by examiner

SYSTEMS AND METHODS FOR AUTOMATICALLY WARNING NEARBY VEHICLES OF POTENTIAL HAZARDS

RELATED APPLICATIONS

The present application is a continuation application of U.S. patent application Ser. No. 16/526,752, filed Jul. 30, 2019, which is a continuation application of U.S. patent application Ser. No. 15/957,631, filed Apr. 19, 2018, issued as U.S. Pat. No. 10,522,038 on Dec. 31, 2019, both entitled "Systems and Methods for Automatically Warning nearby Vehicles of Potential Hazards," the disclosure of which applications are hereby incorporated by reference herein in their entirety.

BACKGROUND

Hazards in the roadway can pose significant safety risks to nearby vehicles. Oftentimes, it is difficult or impossible to detect a hazard until it is too late to safely avoid the hazard, especially when another vehicle, contours in the road, or infrastructure block or obstruct a line of sight to the hazard. The issue is compounded due to the increased risk of colliding with surrounding vehicles, especially as multiple vehicles attempt to avoid the hazard. Therefore, there is a need for improved ways for warning vehicles of potential safety hazards in or near the roadway to improve safety.

SUMMARY

The present disclosure is directed to a system for automatically warning at least one nearby vehicle of a potential safety hazard in or near a roadway. The system, in various embodiments, may comprise one or more sensors configured to detect a potential safety hazard in or near a roadway; a memory containing computer-readable instructions for generating a message including at least one of a location of the one or more sensors and a location of the potential safety hazard; a processor configured to read the computer-readable instructions from the memory and generate the message; and a transmitter configured to wirelessly transmit the message to at least one nearby vehicle.

The one or more sensors, in various embodiments, may include at least one of a camera, an image sensor, an optical sensor, a sonic sensor, a traction sensor, a wheel impact sensor, and a location sensor. In an embodiment, the one or more sensors may include at least one sensor configured to measure a distance between the sensor and the potential safety hazard. The location of the potential safety hazard, in an embodiment, may be determined by or using information provided by the one or more sensors. The one or more sensors, in various embodiments, may be located onboard a vehicle or may be deployed in or near the roadway.

The one or more sensors, in some embodiments, may include at least one sensor configured for measuring at least one of a velocity and heading of the potential safety hazard. The location of the potential safety hazard, as well as at least one of the measured velocity and heading of the potential safety hazard, may be included in the message. In an embodiment, the message may further include a time stamp indicating when the message was generated.

In various embodiments of the system, the one or more sensors may be located onboard a first vehicle. In an embodiment, the one or more sensors may include at least one sensor configured for measuring at least one of a velocity and heading of the first vehicle. The location of the first vehicle, as well as at least one of the measured velocity and heading of the first vehicle, may be included in the message. In an embodiment, the message may further include a time stamp indicating when the message was generated.

The processor, in an embodiment, may be further configured to identify a nature of the potential safety hazard using, at least in part, information collected by the one or more sensors, and include the information concerning the nature of the potential safety hazard in the message.

The present disclosure, in another aspect, is directed to a method for automatically warning at least one nearby vehicle of a potential safety hazard in or near a roadway. The method, in various embodiments, may comprise detecting a potential safety hazard in or near a roadway using one or more sensors; generating a message including information concerning at least one of a location of the one or more sensors and a location of the potential safety hazard; and transmitting the message wirelessly to at least one nearby vehicle.

The method, in various embodiments, may include determining the location of the potential safety hazard using information provided by the one or more sensors. In an embodiment, determining the location may include measuring a distance between at least one of the one or more sensors and the potential safety hazard, and relating the distance to a location of the one or more sensors.

The method, in various embodiments, may further include measuring at least one of a velocity and heading of the potential safety hazard, and including, in the message, the location of the potential safety hazard and at least one of the measured velocity and heading of the potential safety hazard. Additionally or alternatively, the method, in various embodiments, may further include measuring at least one of a velocity and heading of the first vehicle, and including, in the message, the location of the first vehicle and at least one of the measured velocity and heading of the first vehicle. The method may further entail including, in the message, a time stamp indicating when the message was generated.

The method, in various embodiments, may further include identifying a nature of the potential safety hazard using, at least in part, information collected by the one or more sensors, and including, in the message, information concerning the nature of the potential safety hazard.

In various embodiments, the method may be implemented according to instructions stored on a non-transitory machine readable medium that, when executed on a computing device, cause the computing device to perform the method.

In yet another aspect, the present disclosure is directed to a system for coordinating actions of a first vehicle and a second vehicle upon detection of a potential safety hazard in or near a roadway. The system, in various embodiments, may include a first vehicle and a second vehicle. The first vehicle may include one or more sensors configured to detect a potential safety hazard in or near a roadway; a processor configured to identify one or more actions to be taken by the first vehicle for avoiding or mitigating a risk of collision with the potential safety hazard, and generate a message including the information concerning the potential safety hazard and the one or more actions to be taken by the first vehicle; and a transceiver configured to transmit the message. The second vehicle may include a transceiver configured to receive the message; and a processor configured to identify, based on the information concerning the potential safety hazard, one or more actions to be taken by the second vehicle for avoiding or mitigating a risk of collision with the potential safety hazard and the first vehicle, evaluate whether the one or more actions to be taken by the second vehicle conflict with the one or more actions to be taken by the first vehicle, and if the actions conflict, generate a second message for transmission to the first vehicle including a request that the processor of the first vehicle execute one or more alternative actions for avoiding or mitigating the risk of collision with the potential safety hazard.

DETAILED DESCRIPTION

Figure 1:
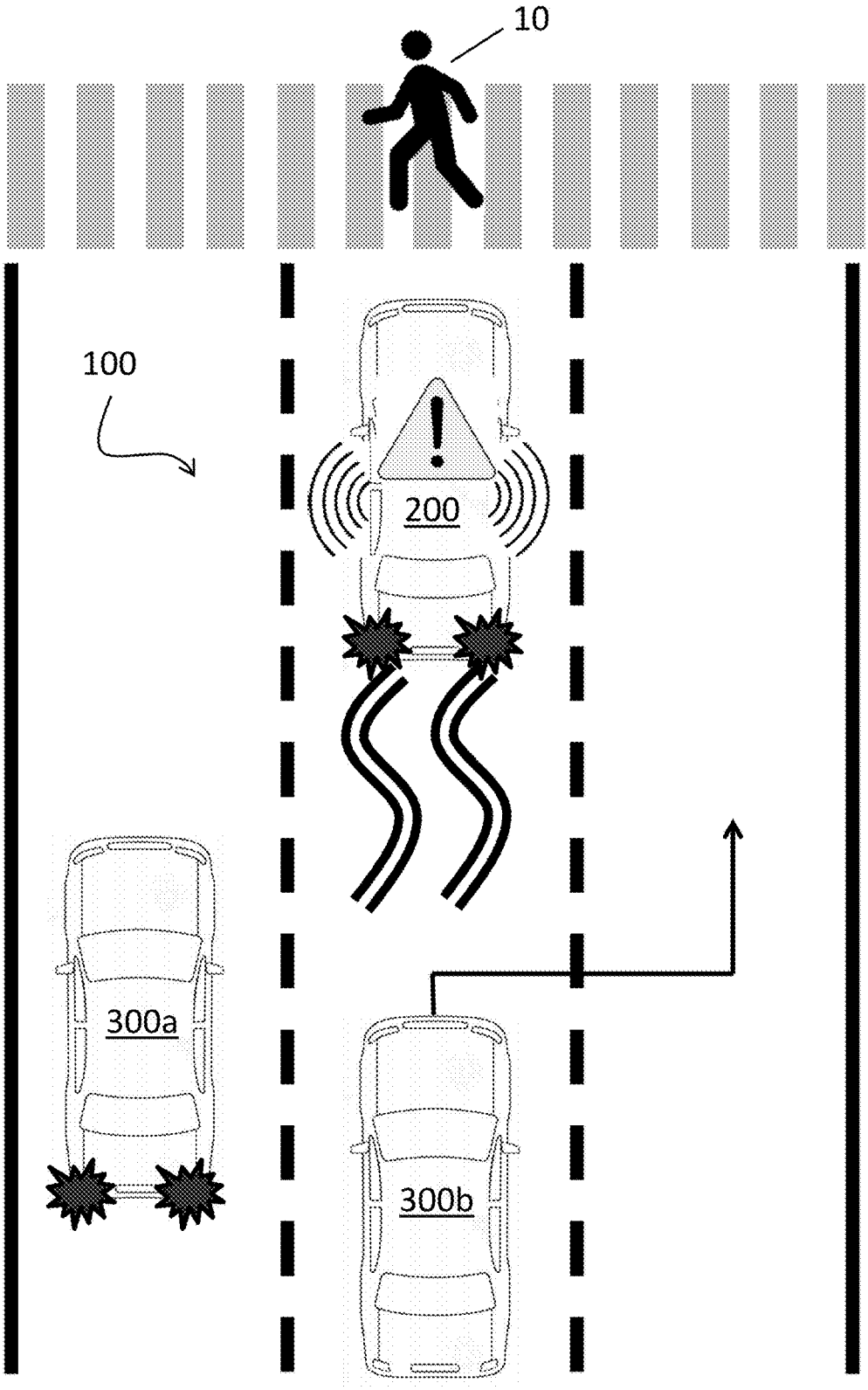
FIG. 1 schematically depicts a representative system for generating and transmitting a message(s) configured for warning nearby vehicle(s) of a potential safety hazard in or near the roadway, according to an embodiment of the present disclosure.

Embodiments of the present disclosure include systems and methods for generating and transmitting a message(s) configured for warning the driver(s) or autonomous control system(s) of the nearby vehicle(s) of a potential safety hazard in the roadway. In many cases, these warning messages may alert the driver(s) of the nearby vehicle(s) of the potential hazard before the driver(s) could have visually detected the hazard themselves, thereby allowing the driver(s) to take evasive action earlier than he/she otherwise may have absent the warning message. For example, a nearby vehicle may be blocking the driver's line of sight to the hazard, or the hazard may not be visible around a curve in the road until the last second. Similarly, these warning messages may improve safety in cases where the driver(s) of the nearby vehicle(s) is already alert to a potential hazard (perhaps due to the behavior of other vehicles reacting to the potential hazard), but may not know whether there actually is a hazard, let alone its nature and what action needs to be taken to avoid it. The present systems and methods are similarly suited for warning autonomous vehicles of roadway hazards (in particular, their control systems, as opposed to drivers) with similar benefits, as later described in more detail.

Within the scope of the present disclosure, the term "hazard" and derivatives thereof generally refers to any object, being, road condition, or similar in or near the roadway that poses or may pose a safety risk to vehicular traffic, pedestrians, infrastructure, and/or the hazard itself. By way of example and without limitation, representative hazards may include a stopped or rapidly-braking vehicle, a motor vehicle accident, a pedestrian or animal, debris, roadway damage (e.g., pothole), or dangerous roadway conditions (e.g., slipperiness due to icy, rain, oil, etc.).

Within the scope of the present disclosure, the term "message" and derivatives thereof generally refers to any electronic message generated and transmitted that contains information suitable for warning another vehicle or vehicles of a hazard. As later described in more detail, messages may include anything from a simple indication that a potential hazard exists to suite of additional details concerning the nature, location, and movement of the hazard, amongst other relevant information. Messages will typically be transmitted and received wirelessly.

Within the scope of the present disclosure, the terms "piloted vehicle", "human-piloted vehicle," and derivatives thereof generally refer to vehicles such as, without limitation, cars, trucks, motorcycles, aircraft, and watercraft that are wholly or substantially piloted by a human. For clarity, vehicles featuring assistive technologies such as automatic braking for collision avoidance, automatic parallel parking, cruise control, and the like shall be considered piloted vehicles to the extent that a human is still responsible for controlling significant aspects of the motion of the vehicle in the normal course of driving. A human pilot may be present in the piloted vehicle or may remotely pilot the vehicle from another location via wireless uplink.

Within the scope of the present disclosure, the term "autonomous vehicle" and derivatives thereof generally refer to vehicles such as cars, trucks, motorcycles, aircraft, and watercraft that are piloted by a computer control system either primarily or wholly independent of input by a human during at least a significant portion of a given trip. Accordingly, vehicles having "autopilot" features during the cruising phase of a trip (e.g., automatic braking and accelerating, maintenance of lane) may be considered autonomous vehicles during such phases of the trip where the vehicle is primarily or wholly controlled by a computer independent of human input. Autonomous vehicles may be manned (i.e., one or more humans riding in the vehicle) or unmanned (i.e., no humans present in the vehicle). By way of illustrative example, and without limitation, autonomous vehicles may include so called "self-driving" cars, trucks, air taxis, drones, and the like.

Some embodiments of the present disclosure even provide systems and methods for coordinating actions amongst nearby vehicles in an effort to avoid collisions amongst the vehicles themselves as they attempt to avoid the potential hazard, as later described in more detail.

Further embodiments of the present disclosure include systems and methods for coordinating actions amongst nearby vehicles in an effort to avoid collisions amongst the vehicles themselves as they attempt to avoid the potential hazard. In particular, in an embodiment, the message may include information concerning action(s) that one or more of the vehicles plans to take and/or is taking, as later described in more detail. As configured, the driver or control system of a vehicle(s) receiving the message can factor this information into planning or modifying its own response to the hazard. Additionally or alternatively, in an embodiment, a vehicle(s) receiving such a message may in turn respond with a message of its own containing similar information concerning the actions it plans to take or is taking, thereby allowing the vehicles to further coordinate as the situation rapidly evolves. In cases where a vehicle has only one option for avoiding a collision with the hazard and/or other vehicles, this cross-talk may enable nearby vehicles to alter any conflicting actions, the situation permitting, thereby allowing the limited-option vehicle to implement its only available option for avoiding a collision, as later described in more detail.

FIG. 1 schematically depicts a representative system 100 for generating and transmitting a message(s) 12 configured for warning nearby vehicle(s) of a potential safety hazard in or near the roadway. System 100 envisions a situation in which a vehicle 200 detects the hazard 10 (here, a pedestrian in a crosswalk) and warns one or more nearby vehicles 300*a*, 300*b*.

In the representative example shown, vehicle 200 is obstructing lines of sight between vehicles 300*a*, 300*b* and hazard 10, and thus the drivers and/or sensors of vehicles 300*a*, 300*b* may not be aware of hazard 10. The message 12 generated and transmitted by vehicle 200 alerts vehicles 300*a*, 300*b* to the presence of the hazard, allowing vehicle 300*a* in the left lane to brake prior to reaching the crosswalk and vehicle 300*b* to escape into the open right lane to avoid rear-ending vehicle 200, which itself is rapidly braking to avoid running over the pedestrian walking directly in front. Thanks to the hazard warning message 12 generated by and transmitted from vehicle 200, all three vehicles avoid colliding with the pedestrian and each other, resulting in a safe outcome.

Figure 2:
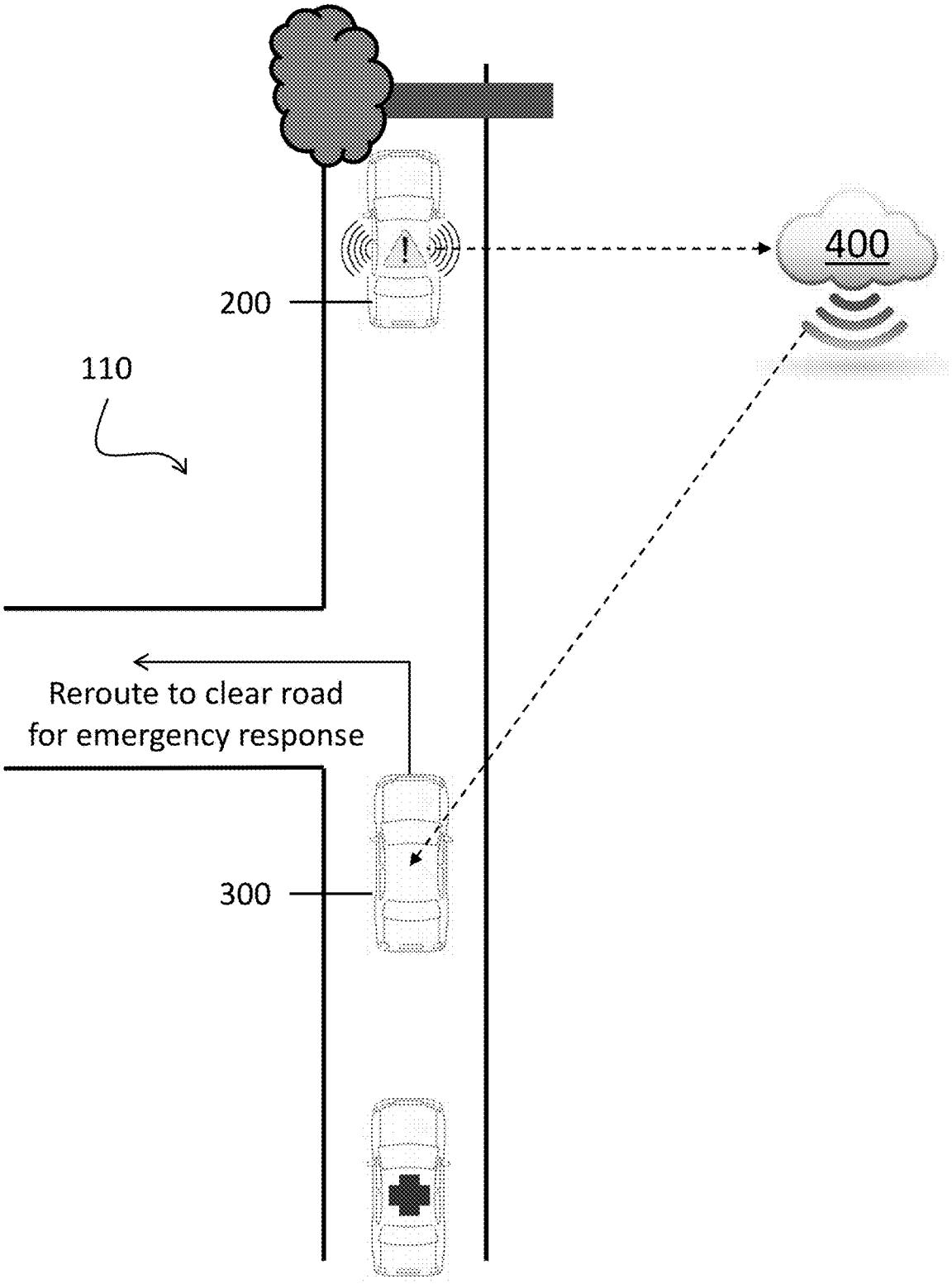
FIG. 2 schematically depicts a representative system for generating and transmitting a message(s) configured for warning nearby vehicle(s) of a potential safety hazard in or near the roadway, according to another embodiment of the present disclosure.

FIG. 2 schematically depicts another representative system 110 for generating and transmitting a message(s) 12 configured for warning nearby vehicle(s) of a potential safety hazard in or near the roadway. System 110 envisions a situation in which a vehicle 200 detects a hazard 10 (here, fallen tree blocking the road) and warns another vehicle 300 to reroute, thereby avoiding hazard 10 and minimizing any resulting traffic congestion that may otherwise delay the arrival of emergency responders to the scene.

While, in an embodiments vehicle 200 may transmit the hazard warning message 12 directly to vehicle 200 (not shown), in some embodiments vehicle 200 may additionally or alternatively transmit the message 12 indirectly to vehicle 300 via a remote server 400, such as a cloud server. Such a configuration may have several benefits. First, as configured, system 110 may be able to provide warnings to vehicles 300 at distances far from the hazard 10, thereby providing vehicle 300 with more notice and options for rerouting. Second, remote server 400 may be configured to relay the hazard warning message 12 to authorities, who may otherwise not know of the hazard. This, in turn, may allow authorities to dispatch responders more quickly and efficiently, as well as to better manage large volumes of traffic that may impacted by the presence of hazard 10. In an embodiment, remote server 400 may be configured with traffic control algorithms for automatically rerouting traffic in response to hazard 10.

Figure 3:
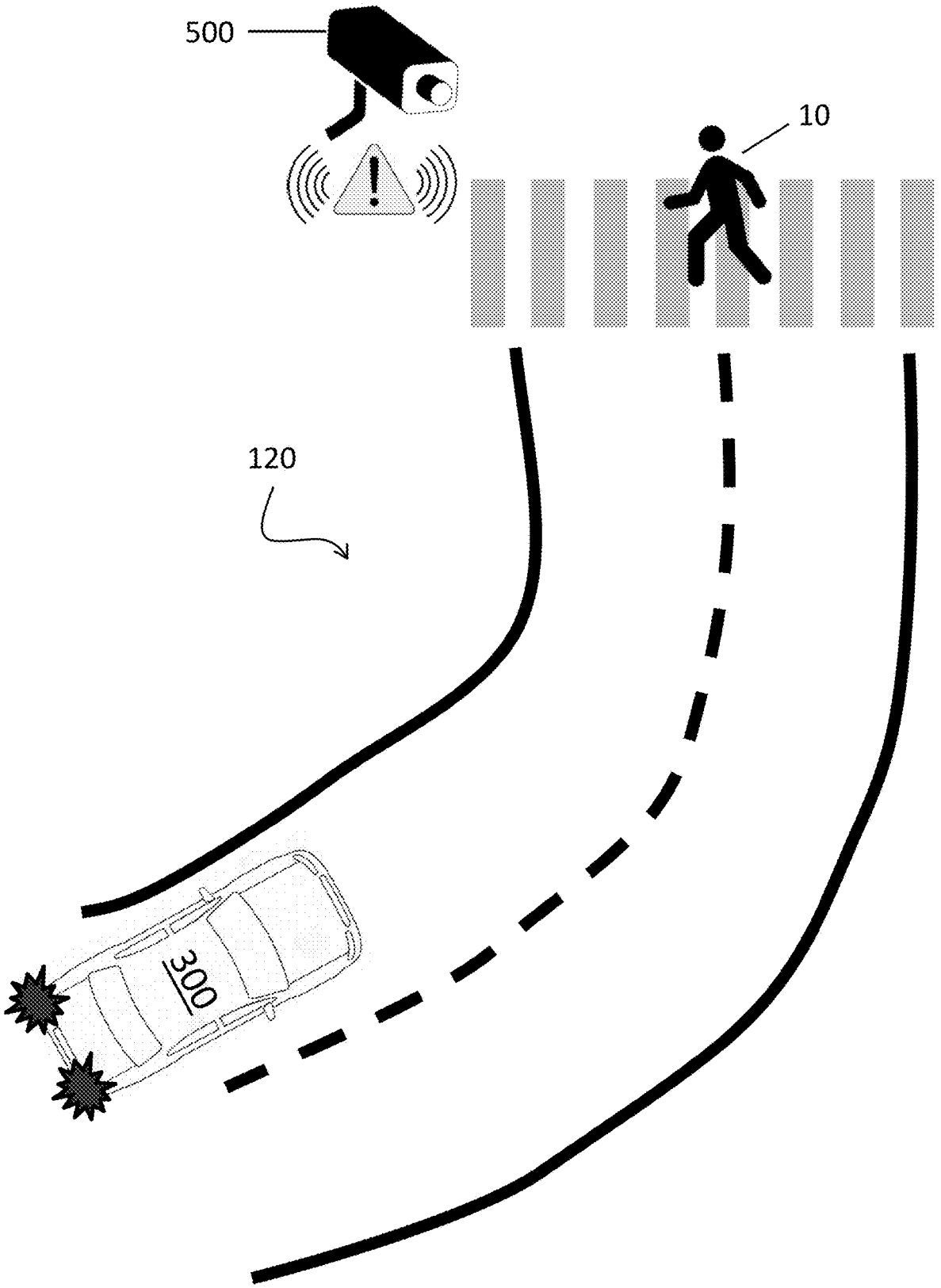
FIG. 3 schematically depicts a representative system for generating and transmitting a message(s) configured for warning nearby vehicle(s) of a potential safety hazard in or near the roadway, according to another embodiment of the present disclosure.

FIG. 3 schematically depicts yet another a representative system 120 for generating and transmitting a message(s) 12 configured for warning nearby vehicle(s) of a potential safety hazard in or near the roadway. System 120 envisions a situation in which a deployed sensor 500, such as a traffic camera, detects the hazard 10 (here, a pedestrian in a crosswalk) and warns a nearby vehicle 300 approaching the hazard 10 from around a blind curve in the roadway. The hazard warning message 12 enables vehicle 300 to safely brake in advance of the crosswalk, despite not being able to see hazard 10, thereby avoiding a possible collision.

Vehicle 200 and Deployed Sensor 500

Figure 4:
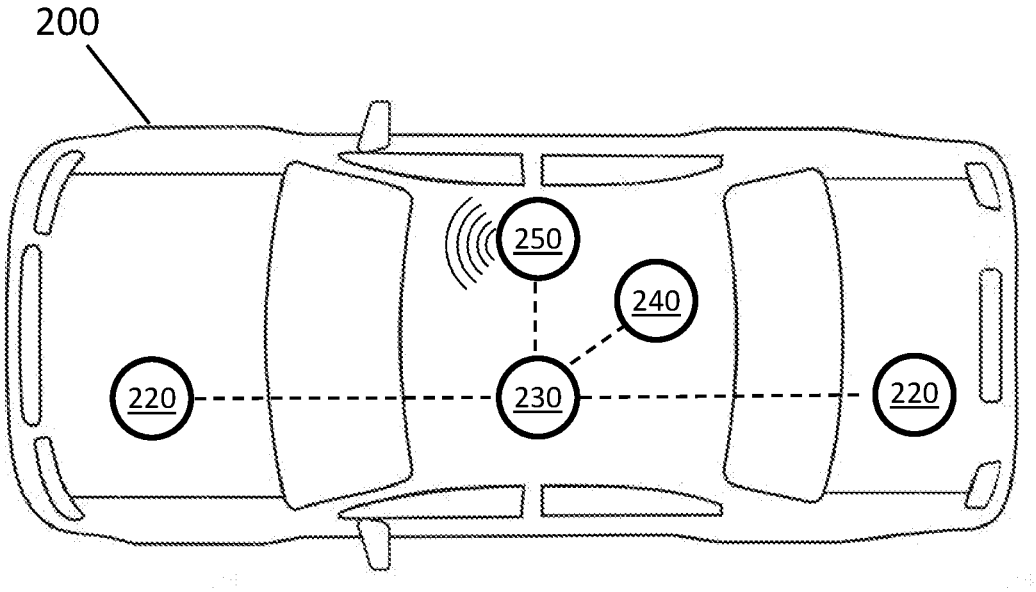
FIG. 4 is a schematic illustration of a sensing system located onboard a vehicle of various systems for detecting a hazard, according to an embodiment of the present disclosure.

FIG. 4 is a schematic illustration of a sensing system located onboard vehicle 200 of systems 100, 110 for detecting a hazard 10. The sensing system, in various embodiments, may generally include one or more sensors 220, a processor 230, memory 240, and a transmitter or transceiver 250.

The sensing system, in various embodiments, may include one or more sensors 220 configured to detect and/or identify one or more hazards 10 proximate vehicle 200. In various embodiments, sensors 220 may include those sensors typically found in many piloted and autonomous vehicles today. For example, sensors 220 may include one or more image sensors be configured to capture imagery to which image processing techniques such as person-, object-, and/or vehicle-recognition algorithms may be applied. Additionally or alternatively, one or more optical ranging sensors (e.g., LIDAR, infrared), sonic ranging sensors (e.g., sonar, ultrasonic), or similar sensors may be positioned about the vehicle to detect and/or range potential hazards 10, as well as surrounding vehicles 300. Any one or combination of such sensors, in various embodiments, may be positioned about the perimeter of vehicle 200 (e.g. on the front, rear, top, sides, and/or quarters). Still further, traction sensors (e.g., loss of traction in one or more wheels) or other suitable sensors may be utilized to identify slippery hazards 10, such as ice, rain, or oil. Moreover, wheel impact sensors (e.g., sudden compression of or force applied to vehicle's 200 suspension), such as force sensors, pressure sensors, gyros, and the like may be utilized to identify hazards 10 that vehicle 200 has run over, such as potholes or debris in the roadway.

Additionally, sensors 220 may be configured to collect information regarding the roadway on which vehicle 200 is operated, such as road lane dividers (e.g., solid and dashed lane lines), medians, curbs, concrete barriers, and the like. Representative sensors configured to collect information regarding the surrounding environment may include outward-facing cameras positioned and oriented such that their respective fields of view can capture the respective information each is configured to collect. For example, cameras configured to capture road lane dividers may be positioned on the side of or off a front/rear quarter of vehicle 200 and may be oriented somewhat downwards so as to capture road lane dividers on both sides of vehicle 200. Likewise, global positioning system (GPS) or other location-related sensors may be utilized to monitor the location of vehicle 200 in the roadway.

The sensing system, in various embodiments, may further include one or more sensors 220 for measuring operational aspects of vehicle 200, such as location, speed, acceleration, braking force, braking deceleration, and the like. Representative sensors 220 configured to collect information concerning operational driving characteristics may include, without limitation, tachometers like vehicle speed sensors or wheel speed sensor, brake pressure sensors, fuel flow sensors, steering angle sensors, location sensors (e.g., GPS, GNSS) and the like. In various embodiments, some or all of the operational information collected by such sensors may be included in the hazard warning message 12 generated by vehicle 200 for consideration by vehicle(s) 300 in determining which actions to take in response to hazard 10. Additionally or alternatively, in various embodiments, some or all of the operational information collected by such sensors may be used by vehicle 200 itself in evaluating options for avoiding a collision with hazard 10. For example, vehicle 200 may utilize ranging information and vehicle speed to evaluate if vehicle 200 is capable of stopping in time to avoid colliding with hazard 10; if not, vehicle 200 may opt for other actions such as swerving into an adjacent lane if clear (as detected by sensors 220.

The sensing system, in various embodiments, may additionally or alternatively include one or more sensors 220 configured to collect information concerning the presence of other nearby vehicles 300 such as each vehicle's 300 location, direction of travel, rate of speed, and rate of acceleration/deceleration, as well as similar information concerning the presence of nearby pedestrians. Representative sensors configured to collect such information may include outward-facing cameras positioned and oriented such that their respective fields of view can capture the respective information each is configured to collect. For example, outward-facing cameras may be positioned about the perimeter of autonomous vehicle 200 (e.g. on the front, rear, top, sides, and/or quarters) to capture imagery to which image processing techniques such as vehicle recognition algorithms may be applied. Additionally or alternatively, one or more optical sensors (e.g., LIDAR, infrared), sonic sensors (e.g., sonar, ultrasonic), or similar detection sensors may be positioned about the vehicle for measuring dynamic operating environment information such as distance, relative velocity, relative acceleration, and similar characteristics of the motion of nearby piloted or autonomous vehicles 300.

The sensing system, in various embodiments, may leverage as sensor(s) 220 those sensors typically found in most autonomous vehicles such as, without limitation, those configured for measuring speed, RPMs, fuel consumption rate, and other characteristics of the vehicle's operation, as well as those configured for detecting the presence of other vehicles or obstacles proximate the vehicle. Sensors 220 may additionally or alternatively comprise aftermarket sensors installed on autonomous vehicle 200 for facilitating the collection of additional information for purposes relate or unrelated to evaluating driving style.

The sensing system of vehicle 200, in various embodiments, may further comprise an onboard processor 230, onboard memory 240, and an onboard transmitter 250. Generally speaking, in various embodiments, processor 230 may be configured to execute instructions stored on memory 240 for processing information collected by sensor(s) 220, detecting hazard 10, generating hazard warning message 12, and transmitting hazard warning message 12.

Processor 230, in various embodiments, may be configured to process information from sensor(s) 220 for subsequent offboard transmission via transmitter 250. Processing activities may include one or a combination of filtering, organizing, and packaging the information from sensors 220 into formats and communications protocols for efficient wireless transmission to vehicle(s) 300 and/or remote server 400. In such embodiments, the processed information may then be transmitted offboard vehicle 200 by transmitter 250 in real-time or near-real time, where it may be received by nearby piloted or autonomous vehicles 300 and/or remote server 400 as later described in more detail. It should be appreciated that transmitter 250 may utilize short-range wireless signals (e.g., Wi-Fi, BlueTooth) when configured to transmit the processed information directly to nearby piloted or autonomous vehicles 300, and that transmitter 250 may utilize longer-range signals (e.g., cellular, satellite) when transmitting the processed information directly to remote server 400, according to various embodiments later described. In some embodiments, transmitter 250 may additionally or alternatively be configured to form a local mesh network (not shown) for sharing information with multiple nearby piloted or autonomous vehicles 300. Transmitter 250 may of course use any wireless communications signal type and protocol suitable for transmitting the pre-processed information offboard vehicle 200 and to nearby piloted or autonomous vehicles 300 and/or remote server 400.

Like sensor(s) 220, in various embodiments, processor 230 and/or onboard transmitter 250 of system 100 may be integrally installed in vehicle 200 (e.g., car computer, connected vehicles), while in other embodiments, processor 230 and/or transmitter 250 may be added as an aftermarket feature.

In various embodiments, a driver of vehicle 200 may additionally or alternatively be involved in detecting hazard 10. In one such embodiment, vehicle 200 may not be equipped with sensors 220 suitable for directly detecting a given hazard 10, leaving it up to the driver to visually, audibly, or otherwise detect hazard 10. In such cases, sensors 220 of systems 100, 110 may instead detect driver actions that are potentially indicative of the driver's reaction to the presence of a hazard 10, such as honking the vehicle's horn, slamming on the vehicle's brakes, swerving aggressively, or otherwise performing any action potentially indicative of a reaction to the presence of a hazard 10. Systems 100, 110, in various embodiments, may be configured in such cases to automatically generate and transmit a hazard warning message 12 to surrounding vehicles 300. Likewise, vehicle 200 could be equipped with a camera in its interior configured to track the driver's eyes for expressions indicative of surprise, fear, or other responses that may be correlated with the sudden detection of a hazard 10, such as sudden pupil dilation or constriction. Similarly, the eye-tracking camera could watch for driver behaviors that make vehicle 200 itself the potential hazard 10, such as the driver closing his/her eyes in a manner suggestive of nodding off, or the driver looking away from the road at his/her smartphone, radio, or other distraction. Additionally or alternatively, vehicle 200, in various embodiments, may include a dedicated interface for receiving input from the driver to generate and transmit hazard warning message 12. For example, vehicle 200 may include a button or similar interface on the steering wheel that the driver pushes upon detecting a hazard 10, causing systems 100, 110 to automatically generate and transmit a generic hazard alert message 12. Similarly, in various embodiments, vehicle 200 may include a microphone configured to detect sounds associated with sudden detection of hazard by the driver or occupants, such as taking a sudden breath, gasping, screaming, etc. Still further, in various embodiments, vehicle 200 may include or otherwise pair electronically with biological sensors worn or otherwise directed towards the driver for detecting sudden biological changes associated with surprise, fear, adrenaline response, such as rapid spike in heart rate. Systems 100, 110, in various embodiments, may be configured in such cases to automatically generate and transmit a hazard warning message 12 to surrounding vehicles 300.

Like system 100 and 110, in which vehicle 200 includes one or more sensors for detecting hazard 10, system 120 may include one or more deployed sensors 500 configured for similar purposes. Representative deployed sensors 500 include, without limitation, cameras or image sensors positioned and oriented to capture imagery of the roadway and/or surrounding areas. Images captured by these sensors, in an embodiment, can be processed using person-, object-, and/or vehicle-recognition algorithms to detect hazards 10 within a field of view. Additionally or alternatively, one or more optical sensors (e.g., LIDAR, infrared), sonic sensors (e.g., sonar, ultrasonic), or similar detection sensors may be deployed near intersections and other areas of interest along a roadway to detect and/or range potential hazards 10.

Vehicle 300

Figure 5:
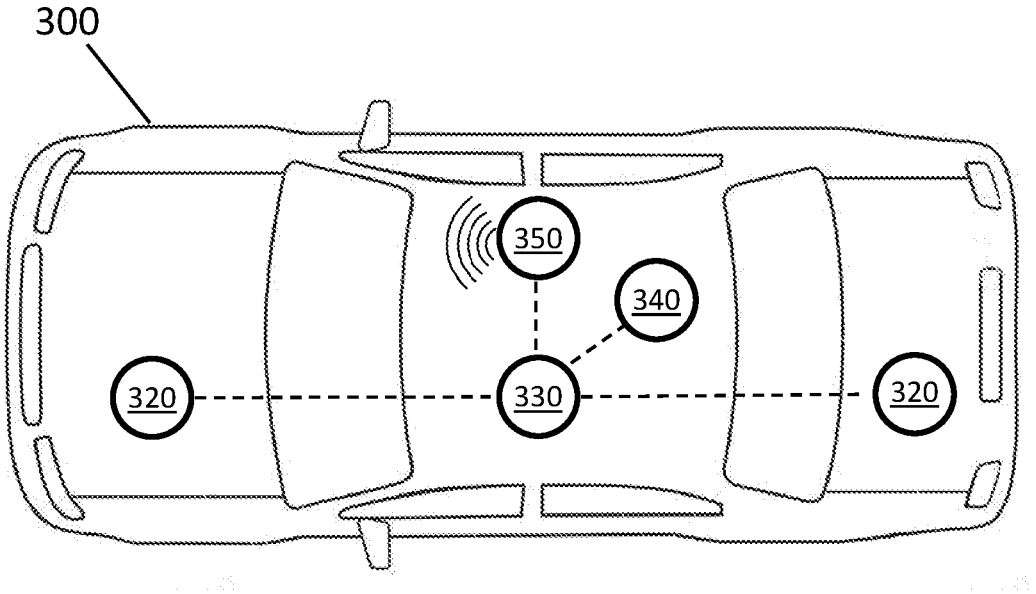
FIG. 5 is a schematic illustration of a representative system located onboard a nearby vehicle for receiving and processing a hazard warning message, according to an embodiment of the present disclosure.

FIG. 5 is a schematic illustration of representative system located onboard vehicle 300 for receiving and processing hazard warning message 12. Whether transmitted directly from vehicle 200 or deployed system 500, or indirectly from remote server 400, hazard warning message 12 may be received and processed by vehicle(s) 300 of the present systems. This system, in various embodiments, may generally include one or more a processor 330, memory 340, and a receiver or transceiver 350. In various embodiments, this system may further include one or more sensors 320 for use in navigation and/or assessing potential evasive actions in response to hazard 10.

Generally speaking, processor 330, memory 340, and receiver/transceiver 350 of vehicle 300 may include hardware and functionality similar to processor 230, memory 240, and transmitter/transceiver 250 of vehicle 200, respectively, albeit adapted for use by a vehicle receiving and reacting to hazard warning message 12, rather than detecting hazard 10 and warning other vehicles. In particular, sensors 320 may, like sensors 220, be configured to collect information regarding the environment in which vehicle 300 is operated, to measure operational aspects of vehicle 300, and/or to collect information concerning the presence of vehicle 200 and/or other nearby vehicles 300. This information may in turn be used by processor 330 in evaluating potential actions to take in response to the presence of hazard 10. Memory 340 may store instructions for operating processor 330 and receiver/transceiver 350 for these purposes, and for example, according to the methods described herein and depicted in FIG. 8.

Like the complementary components in vehicle 200, in various embodiments, sensor(s) 320, processor 330, memory 340, and/or receiver/transceiver 250 may be integrally installed in vehicle 300 (e.g., car computer, connected vehicles) or added as aftermarket features.

Hazard Warning Message 12

Figure 6:
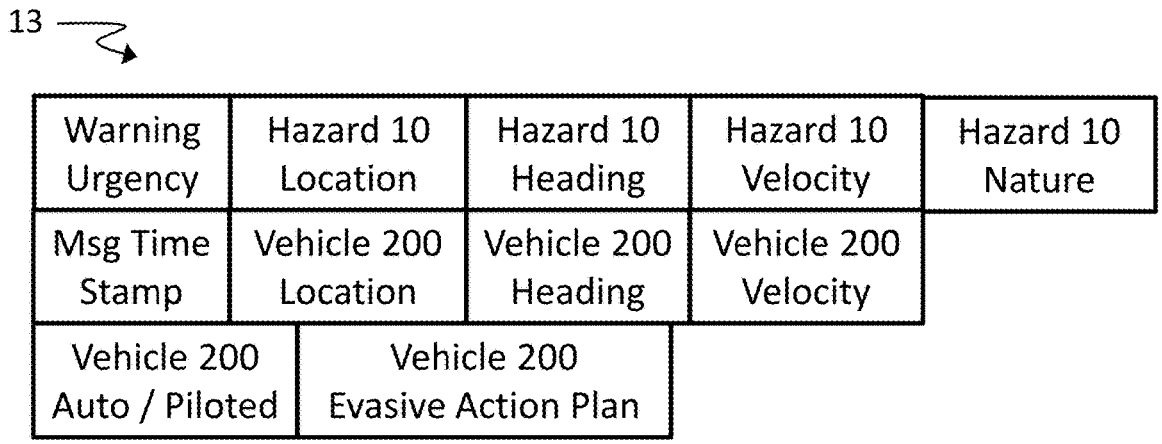
FIG. 6 illustrates a representative payload of a hazard warning message, according to an embodiment of the present disclosure.

FIG. 6 illustrates a representative payload 13 of hazard warning message 12. It should be recognized that the content of payload 13 may be structured and formatted in any suitable manner for transmission via the message protocol used for sending hazard warning message 12.

The content of payload 13, in various embodiments, may include any one or combination of information concerning hazard 10 and information concerning the operation of vehicle 200, amongst any other information known by vehicle 200 or deployed sensor 500 that may be relevant for warning vehicle(s) 300 of hazard 10 and/or assisting vehicle(s) 300 in determining suitable actions for avoiding a collision in response.

For example, payload 13, in various embodiments, may include an indicator describing an urgency level of the warning being sent. For example, hazards 10 may be marked as urgent if they pose an immediate danger to nearby vehicles 300, such as when a pedestrian is detected just ahead of vehicle(s) 300, whereas hazards 10 involving low-risk or far-off hazards 10 may be marked as less urgent. In various embodiments, processor 330 of vehicle 300 may be configured to process hazard warning messages 10 including urgent indicators with higher priority than those hazard warning messages 10 that are marked as less urgent, thereby allowing processor 330 to efficiently manage incoming messages of all types while ensuring that those indicative of urgent hazards are immediately considered such that action can be taken quickly.

Payload 13, in various embodiments, may additionally or alternatively include information concerning the location of hazard 10. In some embodiments, payload 13 may include the discrete location of hazard 10. In one such embodiment, vehicle 200 or deployed sensor 500 may determine the discrete location of hazard 10 and include it directly in payload 13. For example, vehicle 200 or deployed sensor 500 may be configured to determine how far away hazard 10 is from vehicle 200 or deployed sensor 500 (e.g., using ranging technologies such as radar, sonar, LIDAR, infrared), and use this in combination with its own known location to determine the location of hazard 10 for inclusion in payload 13. In such an embodiment, vehicle 200 may know its own location using GPS or similar technologies, and deployed sensor 500, if static, may be pre-programmed with its location.

Payload 13, in various embodiments, may additionally or alternatively include heading and velocity information for hazard 10. This information, in various embodiments, can be used by processor 330 in assessing the likelihood of a collision with hazard 10 on vehicle 300's present course. Further, payload 13, in various embodiments, may additionally or alternatively include information concerning the nature of hazard 10 to the extent this information is available. For example, in some cases, it may be possible for vehicle 200 or deployed sensor 500 may be able to determine the nature of hazard 10 (e.g., pedestrian, bicyclist, animal, large vs. small debris, large vs. small patch of ice) by further processing data from sensors 220 (or from deployed sensor 500 itself). For example, to the extent cameras or image sensors are utilized, person-, animal-, or object-recognition software may be employed to determine the nature of hazard 10. Likewise, to the extent traction-related sensors are utilized by vehicle 200, processor 230 could process the degree to one or more of the wheels of vehicle 200 spun at a different rate than others and for how long to determine the scope of any ice or slippery precipitation vehicle 200 encountered. Information concerning the nature of hazard 10, in various embodiments, may be used by vehicle 300 in assessing the degree of risk posed by a collision with hazard 10, both to vehicle 300 and to hazard 10 itself. This may factor into how a warning is presented to the driver of vehicle 300 or what actions vehicle 300 (if autonomous) may take in response to being warned of hazard 10. For example, if the nature of hazard 10 is determined to be high-risk (e.g., a collision with a pedestrian, large animal, stopped vehicle, large debris, large ice sheet) then processor 330 of vehicle 300 may opt to take more dramatic or dangerous countermeasures to avoid a collision, whereas if the nature of hazard 10 is determined to be of lower risk (e.g., a collision with a small animal, small debris, small patch of ice), then processor 330 of vehicle 300 may opt to implement less risky countermeasures (or even opt to collide with hazard 10) given that the risk of injury posed by some countermeasures may outweigh the risks of a collision with hazard 10.

Additionally or alternatively, payload 13, in various embodiments, may include location, heading, and velocity information for vehicle 200 at the time hazard message 12 was generated. This information, in various embodiments, can likewise be used by processor 330 in assessing the likelihood of a collision with vehicle 200 in the event vehicle 200 were to slam on its brakes or take evasive action to avoid a collision with hazard 10.

Payload 13, in various embodiments, may additionally or alternatively include further information concerning vehicle 200 that may be relevant to vehicle 300's assessment of the developing situation and options for avoiding a collision. For example, as shown in FIG. 6, payload 13 may include an indicator of whether vehicle 200 is autonomous or piloted by a human. Generally speaking, human drivers tend to be less predictable and have slower reaction times than computerized control systems of autonomous vehicles. As such, vehicle 300 may benefit from the knowledge of whether vehicle 200 is autonomous or human piloted in assessing its options for avoiding a collision. In embodiments where vehicle 200 is autonomous (or even semi-autonomous, for example, where vehicle 200 has an automatic braking system when a hazard 10 is detected in front of vehicle 200), payload 13 may additionally or alternatively contain information concerning an evasive actions (e.g., braking, swerving) vehicle 200 plans to take to avoid hazard 10. While computing such an action plan may add to the time it takes to generate and transmit hazard warning message 12 to vehicle 300, in some cases it may be advantageous to incur such a delay if the benefit of vehicle 300 knowing how vehicle 200 will react helps vehicle 300 avoid a collision with vehicle 200. Further, as later described in more detail, in various embodiments, processor 330 may be further configured to exchange hazard response messages with vehicle 200 for coordinating the actions each vehicle 200, 300 takes to avoid hazard 10 and each other.

It should be appreciated that, while vehicle 200 and deployed sensor 500 may be configured to transmit hazard message 12 in real-time or near-real time, even a small amount of lag or delay in the generation and transmission of hazard message 13 could affect the ability of vehicle 300 to determine and implement successful maneuvers for evading hazard 10 and any nearby vehicles. Accordingly, in various embodiment, hazard warning message 12 may be configured with a time stamp or other indicator suitable for identifying when hazard warning message 12 was generated by processor 230 of vehicle 200 or by deployed sensor 500. In the embodiment of FIG. 6, a time stamp may be included in payload 13. As configured, processor 330 of vehicle 300 may compare the time stamp included in payload 13 with the time hazard warning message 12 was received by receiver/transceiver 350, and thus determine whether and how much of a delay elapsed between the time when hazard warning message 12 was generated and when hazard warning message 12 was received.

Processor 330, in various embodiments, may be further configured to estimate how much any of the information contained in payload 13 may have changed during the delay, in an attempt to avoid operating on dated information. In an embodiment, processor 330 may be configured to estimate hazard's 10 current location based on an extrapolation of the location, heading, and velocity information for hazard 10 contained in payload 13. For example, processor 330 may estimate the distance hazard 10 has travelled during the delay by multiplying hazard's 10 velocity (as indicated in payload 13) by the length of the delay (i.e., distance=rate× time), and apply this distance to hazard's 10 location (as indicated in payload 13) in a direction corresponding to hazard's 10 heading (as indicated in payload 13), thereby estimating hazard's 10 new location at the current time.

Processor 330, in various embodiments, may be further configured to estimate how much any of the information contained in payload 13 may have changed during the delay, in an attempt to avoid operating on dated information. In an embodiment, processor 330 may be configured to estimate hazard's 10 current location based on an extrapolation of the location, heading, and velocity information for hazard 10 contained in payload 13. For example, processor 330 may estimate the distance hazard 10 has travelled during the delay by multiplying hazard's 10 velocity (as indicated in payload 13) by the length of the delay (i.e., distance=rate× time), and apply this distance to hazard's 10 location (as indicated in payload 13) in a direction corresponding to hazard's 10 heading (as indicated in payload 13), thereby estimating hazard's 10 new location at the current time.

Payload 13, in various embodiments, may additionally or alternatively include information that can be used instead by vehicle 300 to determine or estimate the location of hazard 10. For example, in an embodiment, payload 13 may include a location of vehicle 200 or deployed sensor 500, along with information concerning a distance and/or heading to hazard 10, such that processor 330 of vehicle 300 may calculate the location of hazard 10. Vehicle 300 could then, in turn, determine the relative location of hazard 10 to the location of vehicle 300 (which, e.g., vehicle 300 has determined using sensors 320).

In some situations it is foreseeable that vehicle 200 or deployed sensor 500 may not be able to identify the precise location of hazard 10, and/or a heading and velocity of hazard 10. Despite this, in many cases, it can still be helpful to alert nearby vehicles to the existence of hazard 10 so that their drivers and/or autonomous control systems are alerted to the likelihood of sudden danger posed by hazard 10, vehicle 200, or other nearby vehicles. In an embodiment, payload 13 may simply carry an indicator that a hazard 10 has been detected. In another embodiment, payload 13 may contain any relevant information that is available about hazard 10. For example, it is still better to know that a hazard 10 exists and where it is generally located, than to know only that a hazard 10 exists and have to look all over for it. In yet another embodiment, one in which information concerning hazard 10 is unavailable, payload 13 may still contain information concerning the location of vehicle 200, as this may give vehicle 300 an indirect indicator of where hazard 10 is likely to be generally.

In this latter case, processor 330, in various embodiments, may be further configured to estimate how far and in what direction vehicle 200 has travelled since generating the message, in an attempt to avoid operating on dated information. In an embodiment, processor 330 may be configured to estimate vehicle's 200 current location based on an extrapolation of the location, heading, and velocity information for vehicle 200 contained in payload 13. For example, processor 330 may estimate the distance vehicle 200 has travelled during the delay by multiplying vehicle's 200 velocity (as indicated in payload 13) by the length of the delay (i.e., distance=rate×time), and apply this distance to vehicle's 200 location (as indicated in payload 13) in a direction corresponding to vehicle's 200 heading (as indicated in payload 13), thereby estimating vehicle's 200 new location at the current time.

Generating and Transmitting Hazard Warning Message 12 from Vehicle 200/Deployed Sensor 500

Figure 7:
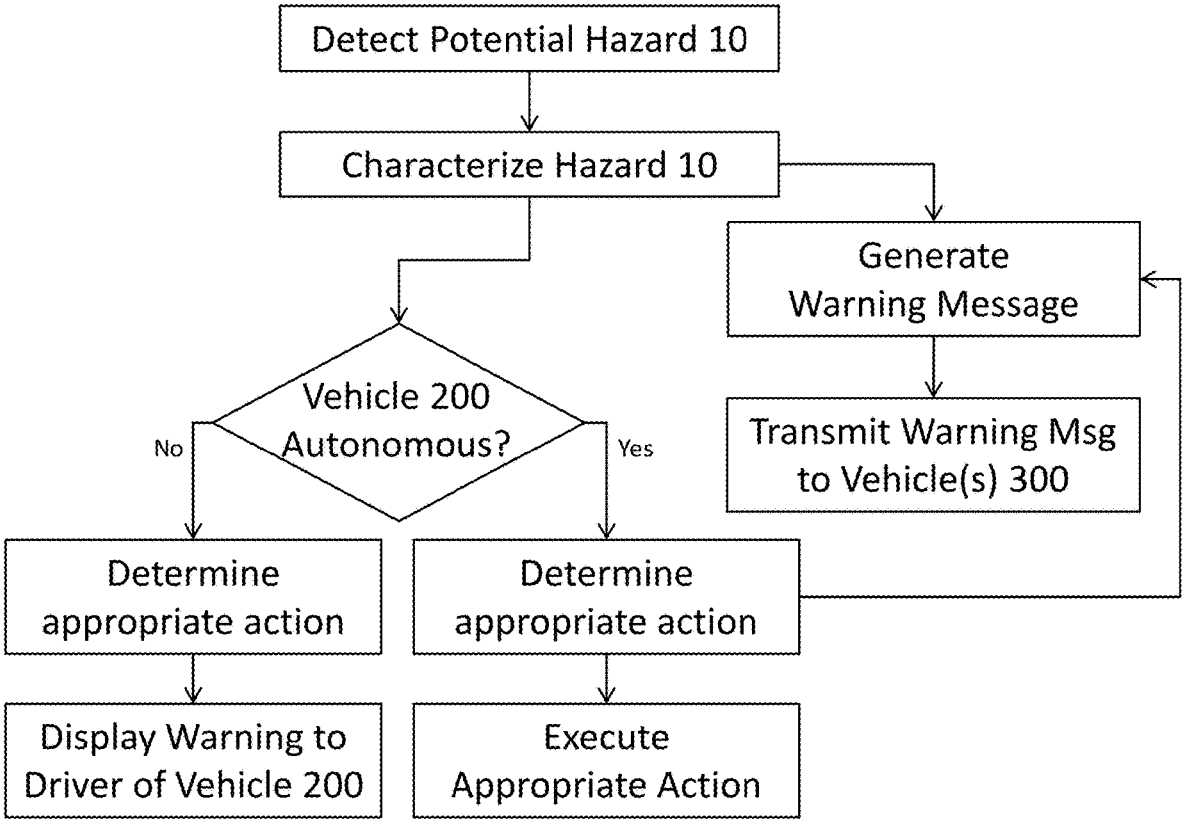
FIG. 7 is a flow chart illustrating a representative approach for detecting a hazard, generating a hazard warning message, and transmitting the hazard warning message to a nearby vehicle(s), according to an embodiment of the present disclosure.

FIG. 7 is a flow chart illustrating a representative approach for detecting hazard 10, generating hazard warning message 12, and transmitting hazard warning message 12 to vehicle(s) 300. While the representative embodiment shown is drawn to systems 100 and 110 in which a vehicle 200 detects hazard 10, one of ordinary skill in the art will recognize its applicability to system 120 in which a deployed sensor 500 detects hazard 10. In particular, it should be understood that the steps disclosed for detecting hazard 10, as well as those for generating and transmitting hazard warning message 12 are substantially similar regardless of the particular system with which they are used; however, in the case of system 120, due to its likely static nature it is unlikely that deployed sensor 500 will take evasive action in response to detecting hazard 10, nor is it likely that vehicles 300 will need to consider any such action on the part of deployed sensor 500 in formulating their own response actions.

In the representative embodiment shown, methods of the present disclosure may begin with vehicle 200 or deployed sensor 500 detecting the existence of a hazard 10 in or near the roadway. Further information concerning the nature, location, heading, and velocity of hazard 10, along with any other relevant information, may also be collected at this stage. As shown, this additional information may be further evaluated at vehicle 200 or deployed sensor 500 in an effort to further characterize hazard 10—that is, identify its nature, where it is, where it is moving, and other information relevant to assessing what actions are appropriate for avoiding or mitigating the risk of a collision with hazard 10 or surrounding vehicles.

Referring now to the left branch of the flow chart of FIG. 7, vehicle 200 (and more specifically, processor 230, in an embodiment) may determine the appropriate action to take to avoid or mitigate a collision with hazard 10 and/or any surrounding vehicles. This determination, in various embodiments, may optionally depend on whether vehicle 200 is piloted or autonomous, so as to account for any perceived differences in reaction time and abilities of human drivers versus autonomous control systems, as previously mentioned. Regardless of whether vehicle 200 is piloted or autonomous, processor 230 may optionally determine an appropriate action based on any number of relevant factors in addition to the information provided about hazard 10, including for example, the operating characteristics of vehicle 200, the locations, headings, and speeds of nearby vehicles, the availability of a road shoulder or other lanes to maneuver into, etc. As previously described, much if not all of this information may be provided by sensors 220 of vehicle 200, as equipped.

If vehicle 200 is piloted, processor 230 may generate and provide a warning to the driver of vehicle 200, such as a visual warning on the dashboard or heads-up display, an audio warning over the speakers, and/or a tactile warning like vibrating the steering wheel or driver's seat. The warning to the driver may include some or all of the information concerning hazard 10, and in some embodiments, may be tailored from a human-factors perspective to provide the information is a quantity and format easily recognized and rapidly processed by a human. For example, a representative warning may include an attention-grabbing visual or audio cue indicative of the detection of hazard 10 (e.g., displaying a hazard symbol and/or sounding an audible alarm) and displaying an arrow pointing in the direction of the hazard, if known. The warning may further include information concerning the appropriate action determined by processor 230 for avoiding or mitigating the risk of collision with hazard 10 and any nearby vehicles. For example, instructions such as "BRAKE!" or "MOVE RIGHT!" or "MOVE RIGHT AND BRAKE!" may be displayed or sounded as suggestions to the driver. This feature, in various embodiments, may of course be disabled by the driver in advance if he/she does not wish to hear suggested actions but rather only wishes to be alerted to hazard 10.

If vehicle 200 is autonomous (or semi-autonomous, to the extent that the appropriate action is determined to be best implemented by semi-autonomous features like reactive braking), processor 230 of vehicle 200 may automatically execute the appropriate action, as shown. Referring to the arrow extending from the left branch to the right branch of FIG. 7, in an embodiment, processor 230 may include information concerning the appropriate action about to be taken or being taken by autonomous vehicle 200 in hazard warning message 12 so as to notify vehicle 300 of what vehicle 200 plans to do (or is already doing). As configured, the driver, semi-autonomous control system, or autonomous control system of a vehicle 300 receiving hazard warning message 12 can react accordingly to avoid a collision with vehicle 200.

It should be recognized that the left branch of FIG. 7, in full or in part, may be optional in some embodiments of the present disclosure. That is, in some embodiments, systems 100, 110 may simply be configured to detect hazard 10 and warn vehicle(s) 300 without, in serial or in parallel, determining and/or implementing an appropriate response for vehicle 200 itself.

Referring now to the right branch of FIG. 7, after detecting and optionally characterizing hazard 10, systems 100, 110, 120 may generate hazard warning message 12 for transmission to vehicle(s) 300. As previously described, in various embodiments of systems 100, 110, processor 230 may generate hazard warning message 12 in accordance with instructions stored in memory 240 and inputs from sensors 220, with any suitable payload 13 and in a format/protocol suitable for transmission by transmitter/transceiver 250.

Figure 8:
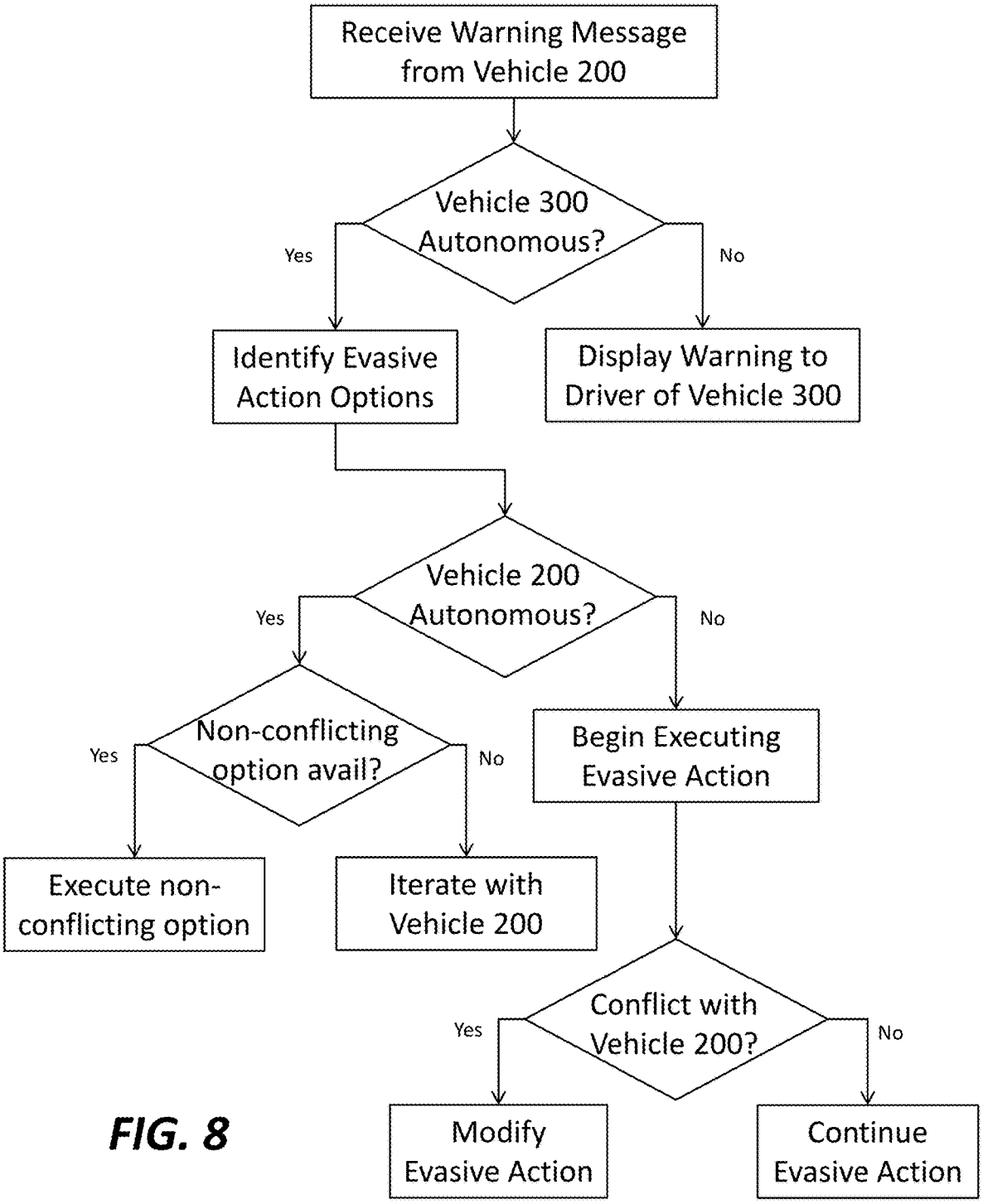
FIG. 8 is a flow chart illustrating a representative approach for leveraging information provided in a hazard warning message to avoid or mitigating a collision with the hazard and a nearby vehicle(s), in accordance with an embodiment of the present disclosure.

Action by Vehicle 300 for Avoiding or Mitigating Collision with Hazard 10 and Nearby Vehicles FIG. 8 is a flow chart illustrating a representative approach by vehicle 300 for leveraging information provided in hazard warning 12 to avoid or mitigating a collision with hazard 10 and any nearby vehicles.

In the representative embodiment shown, methods of the present disclosure may begin with vehicle 300 receiving hazard warning message 12 from vehicle 200 or deployed sensor 500. In particular, in various embodiments, receiver/transceiver 350 may receive hazard warning message 12 and processor 330 may process it for the information contained in payload 13, amongst any other relevant information.

If vehicle 300 is piloted, processor 330, in an embodiment, may automatically generate and provide a warning to the driver of vehicle 300, as shown in the upper right branch of FIG. 8. This warning may be similar to that provided to the driver of a piloted vehicle 200 as described above, and in an embodiment, may include information concerning the planned actions of vehicle 200 if provided in hazard warning message 12. Likewise, in an embodiment (not shown), processor 330 may first evaluate potential options for avoiding or mitigating a collision with hazard 10 and vehicle 200, and present a suggested action to the driver of vehicle 300 as part of the warning provided to the driver of vehicle 300, similar to the way processor 230 may evaluate and suggest actions to the driver of vehicle 200 when piloted.

If vehicle 300 is autonomous, processor 330, in various embodiments, may prepare to evaluate potential options for avoiding or mitigating a collision with hazard 10, vehicle 200, and any nearby vehicles by evaluating the information provided in hazard warning message 12 to identify relevant information concerning hazard 10, such as the location, heading, and speed of hazard 10, along with any information concerning vehicle's 200 operational aspects and planned actions, to the extent provided. Processor 330 may additionally identify any relevant information from sensors 320 of vehicle 300, including the operational aspects of vehicle 300, the environment in which vehicle 300 is operated, and the presence of other nearby vehicles, as available.

Processor 330 may then evaluate potential options for avoiding or mitigating a collision with hazard 10, vehicle 200, and any nearby vehicles using the above-referenced inputs. Like processor 230 of vehicle 200, this evaluation by processor 330 may depend, in part, on whether vehicle 300 is autonomous due to any perceived differences in reaction time and abilities of human drivers versus autonomous control systems, as previously mentioned. Representative response options may include any one or combination of braking, swerving, fully or partially changing lanes, and the like.

Referring now to the bottom half of the flow chart of FIG. 8, in various embodiments, processor 330 may be configured to avoid an action that may conflict with an action to be planned for or being taken by vehicle 200, so as to minimize the risk of a collision between vehicle 300 and vehicle 200 as each attempts to avoid or mitigate a collision with hazard 10. The workflows followed by processor 330 to this end may depend, at least in part, on whether vehicle 200 is piloted or autonomous, as shown.

Referring to the lower right branch of the flow chart of FIG. 8, if vehicle 200 is piloted, processor 330, in various embodiments, may be configured to choose—and modify—its course of action based at least in part on the actions of the driver of piloted vehicle 200, as it may be difficult for processor 330 to predict the actions that will be taken by the driver of piloted vehicle 200. In such an embodiment, processor 330 may evaluate the situation and determine the best option for avoiding or mitigating a collision with hazard 10, vehicle 200, and any other nearby vehicles, but should the driver of piloted vehicle 200 take a conflicting action, it would be up to processor 330 to modify its action plan in response. Generally speaking, such an approach may be intuitive in that, in many cases, vehicle 300 will likely somewhat or completely behind vehicle 200 on the roadway, and thus has a better view of vehicle 200 than the driver of vehicle 200 would have of vehicle 300. Further, such an approach may beneficially offload action deconfliction responsibilities from a human driver.

Referring to the lower left branch of the flow chart of FIG. 8, if vehicle 200 is autonomous, processor 330, in various embodiments, may be configured to evaluate whether a non-conflicting option is available if its preferred option is in conflict with the response planned or being taken be vehicle 200. If a non-conflicting option for avoiding or mitigating the risk of a collision with hazard 10 and nearby vehicles is available, processor 330 may then execute one of the non-conflicting options. For example, if processor 330 determines that vehicle 200 intends to or is braking hard, and that it is possible to change lanes and likely avoid a collision with hazard 10 and vehicle 200, then processor 330 may instruct the control system of vehicle 300 to change lanes accordingly. However, if a non-conflicting option is not available, processor 330, in an embodiment, may attempt to coordinate with processor 230 of vehicle 200 to identify a mutually acceptable action plan. For example, consider a situation in which vehicle 300 is following vehicle 200, and vehicle 300 has another vehicle right next to it making sideways escape impossible. If vehicle 200's planned response to a hazard 10 ahead is to brake hard, and vehicle 300 deduces that it will not be able to stop in time to avoid a significant rear-end collision with vehicle 300, then processor 330 may send a message to processor 230 notifying processor 230 of vehicle 300's lack of acceptable options. In various embodiments, processor 230 may evaluate whether vehicle 200 has any alternative options for avoiding a collision with hazard 10, such as swerving to the right in front of the vehicle travelling to the right of vehicle 300. If such an option exists, and can be implemented fast enough to avoid a collision between vehicle 200 and hazard 10, processor 230 may implement the alternative option and concurrently send a message back to processor 330 notifying it of vehicle's 200 new course of action in response to processor 330's request that processor 230 implement any alternative options such that both vehicles 200, 300 may safely avoid hazard 10 and each other.

While the presently disclosed embodiments have been described with reference to certain embodiments thereof, it should be understood by those skilled in the art that various changes may be made and equivalents may be substituted without departing from the true spirit and scope of the presently disclosed embodiments. In addition, many modifications may be made to adapt to a particular situation, indication, material and composition of matter, process step or steps, without departing from the spirit and scope of the present presently disclosed embodiments. All such modifications are intended to be within the scope of the claims appended hereto.

What is claimed is:

1. A system comprising:

one or more sensors configured to detect a potential safety hazard in or near a roadway;

a memory containing computer-readable instructions for generating a message including at least one of a location of the one or more sensors and a location of the potential safety hazard, and identify one or more actions to be taken by a first vehicle for avoiding or mitigating a risk of collision with the potential safety hazard;

a processor configured to read the computer-readable instructions from the memory and generate the message; and a transceiver to transmit the message to a second vehicle, and to receive from the second vehicle, a second message including a request the processor of the first vehicle execute one or more alternative actions to avoid or mitigate the risk of collision, when actions to be taken by the first and second vehicles conflict.

2. The system of claim 1, wherein the one or more sensors include at least one of a camera, an image sensor, an optical sensor, a sonic sensor, a traction sensor, a wheel impact sensor, and a location sensor.

3. The system of claim 1, wherein the location of the potential safety hazard is determined by or using information provided by the one or more sensors.

4. The system of claim 3, wherein the one or more sensors includes at least one sensor configured to measure a distance between the sensor and the potential safety hazard.

5. The system of claim 1, wherein the one or more sensors include at least one sensor configured for measuring at least one of a velocity and heading of the potential safety hazard, wherein the message includes the location of the potential safety hazard, and wherein the message further includes at least one of the measured velocity and heading of the potential safety hazard.

6. The system of claim 1, wherein the one or more sensors are located onboard the first vehicle.

7. The system of claim 6, wherein the one or more sensors include at least one sensor configured for measuring at least one of a velocity and heading of the first vehicle, wherein the message includes the location of the first vehicle, and wherein the message further includes at least one of the measured velocity and heading of the first vehicle.

8. The system of claim 5, wherein the message further includes a time stamp indicating when the message was generated.

9. The system of claim 1, wherein the processor is further configured to identify a nature of the potential safety hazard using, at least in part, information collected by the one or more sensors, and wherein the message further includes information concerning the nature of the potential safety hazard.

10. The system of claim 1, wherein the one or more sensors are deployed in or near the roadway.

11. A method comprising:

detecting a potential safety hazard in or near a roadway using one or more sensors;

generating a message including information concerning at least one of a location of the one or more sensors and a location of the potential safety hazard, and identify one or more actions to be taken by a first vehicle for avoiding or mitigating a risk of collision with the potential safety hazard; and transmitting the message to a second vehicle, and receiving from the second vehicle, a second message including a request the first vehicle execute one or more alternative actions to avoid or mitigate the risk of collision, when actions to be taken by the first and second vehicles conflict.

12. The method of claim 11, wherein the one or more sensors include at least one of a camera, an image sensor, an optical sensor, a sonic sensor, a traction sensor, a wheel impact sensor, and a location sensor.

13. The method of claim 11, further including determining the location of the potential safety hazard using information provided by the one or more sensors.

14. The method of claim 11, wherein determining the location of the potential safety hazard includes:

measuring a distance between at least one of the one or more sensors and the potential safety hazard, and relating the distance to a location of the one or more sensors.

15. The method of claim 11, further including:

measuring at least one of a velocity and heading of the potential safety hazard, including, in the message, the location of the potential safety hazard and at least one of the measured velocity and heading of the potential safety hazard.

16. The method of claim 11, wherein the one or more sensors are located onboard the first vehicle, and further including:

measuring at least one of a velocity and heading of the first vehicle, and including, in the message, the location of the first vehicle and at least one of the measured velocity and heading of the first vehicle.

17. The method of claim 15, further including in the message a time stamp indicating when the message was generated.

18. The method of claim 11, further including:

identifying a nature of the potential safety hazard using, at least in part, information collected by the one or more sensors, and including, in the message, information concerning the nature of the potential safety hazard.

19. The method of claim 11, wherein the method is implemented according to instructions stored on a non-transitory machine readable medium that, when executed on a computing device, cause the computing device to perform the method.

* * * * *